US008220889B2

(12) United States Patent
Ray et al.

(10) Patent No.: US 8,220,889 B2
(45) Date of Patent: Jul. 17, 2012

(54) WEB FLOW PATH

(75) Inventors: Paul C. Ray, San Diego, CA (US); Neil Doherty, San Diego, CA (US); Mun Yew Lee, San Diego, CA (US); Thomas J. Tarnacki, San Diego, CA (US); Jaren D. Marler, Escondido, CA (US); Robert J. Manders, De Pere, WI (US); John W. Godden, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 865 days.

(21) Appl. No.: 12/251,968

(22) Filed: Oct. 15, 2008

(65) Prior Publication Data

US 2009/0122126 A1 May 14, 2009

Related U.S. Application Data

(60) Provisional application No. 60/987,026, filed on Nov. 9, 2007.

(51) Int. Cl.
*B41J 3/00* (2006.01)
*B41J 2/435* (2006.01)

(52) U.S. Cl. ..... 347/4; 347/262; 347/264

(58) Field of Classification Search ..... 347/16, 347/101, 102, 104, 105, 107, 4, 5, 14, 17, 347/262, 264
See application file for complete search history.

(56) References Cited

U.S. PATENT DOCUMENTS

| | | | | |
|---|---|---|---|---|
| 3,599,341 | A * | 8/1971 | Darcy et al. | 34/444 |
| 4,124,156 | A | 11/1978 | Waffner | |
| 4,264,957 | A * | 4/1981 | Pautzke | 700/125 |
| 4,369,906 | A | 1/1983 | Isherwood | |
| 5,502,464 | A | 3/1996 | Takahashi et al. | |
| 5,506,606 | A | 4/1996 | Saikawa et al. | |
| 5,602,571 | A | 2/1997 | Suda et al. | |
| 5,673,074 | A | 9/1997 | Miyauchi | |
| 5,710,587 | A | 1/1998 | Suzuki et al. | |
| 6,169,557 | B1 | 1/2001 | Suzuki et al. | |
| 6,309,046 | B1 * | 10/2001 | Izawa et al. | 347/40 |
| 6,575,555 | B1 | 6/2003 | Markowitz et al. | |
| 7,540,940 | B2 * | 6/2009 | Aust et al. | 162/137 |
| 2007/0070099 | A1 * | 3/2007 | Beer et al. | 347/8 |
| 2008/0124158 | A1 * | 5/2008 | Folkins | 399/396 |

FOREIGN PATENT DOCUMENTS

JP 2003220695 A * 8/2003

* cited by examiner

*Primary Examiner* — Hai C Pham

(57) ABSTRACT

A web flow path extends in a first direction opposite a print head and in a second opposite direction from the print head to a dryer.

19 Claims, 4 Drawing Sheets

WEB FLOW PATH

CROSS-REFERENCE TO RELATED PATENT APPLICATIONS

The present application is related to co-pending U.S. patent application Ser. No. 12/251,977 filed on the same day herewith by Pautzke Ray, Jennifer Marie McCord Brister, Jack A. Overway and William R. James and entitled PRINT HEAD SERVICE SHUTTLE, the full disclosure of which is hereby incorporated by reference. The present application is related to co-pending U.S. patent application Ser. No. 12/251,985 filed on the same day herewith by Pautzke Ray and entitled MOVABLE FLUID RECEIVER, the full disclosure of which is hereby incorporated by reference.

BACKGROUND

Printers may print and dry images on a web of media. The printed image is sometimes contacted and damaged prior to being dried. In addition, such printers may occupy a relatively large amount of floor space.

DETAILED DESCRIPTION OF THE EXAMPLE EMBODIMENTS

Figure 1:
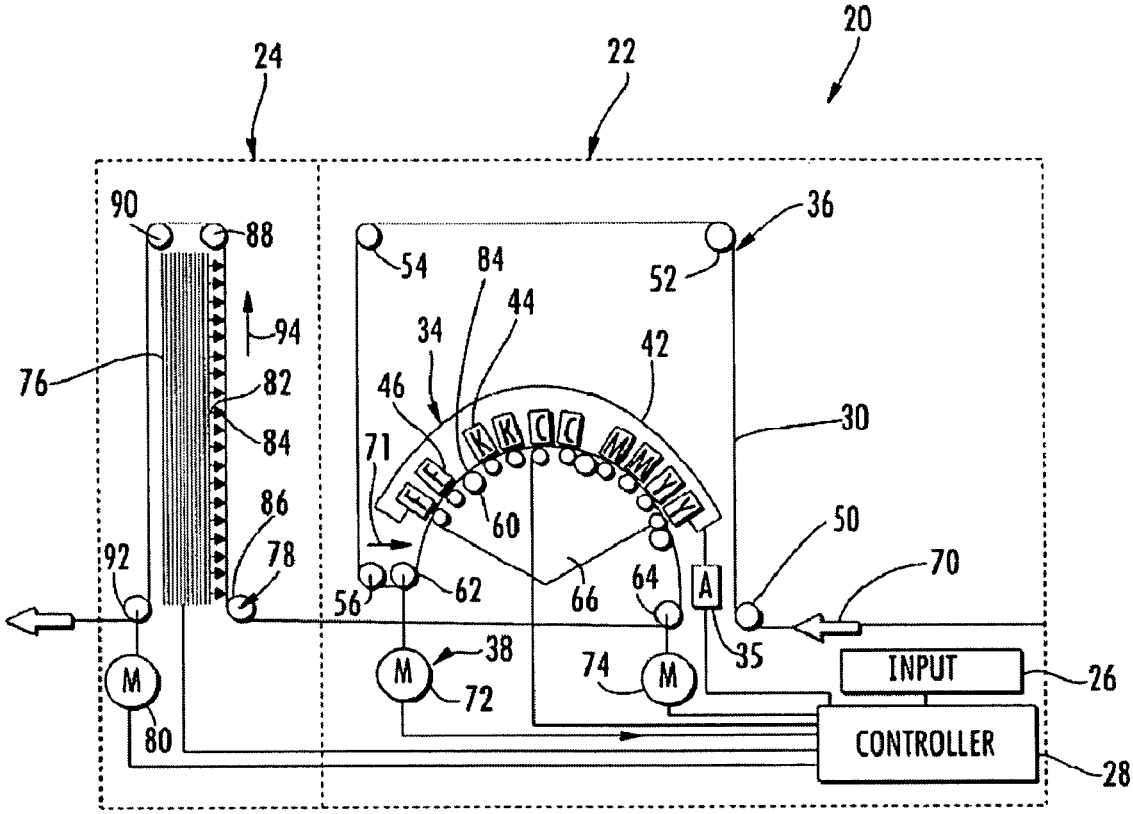
FIG. 1 is a side elevation of you schematically illustrating a printing system according to an example embodiment.

FIG. 1 schematically illustrates printing system according to one example embodiment. Printing system 20 is configured to print upon a web of print media. In the particular embodiment illustrated, printing system 20 is further configured to dry the printed image on the web media. As will be described hereafter, printing system 20 has a layout and a web flow path that facilitates enhanced print quality while occupying less floor space.

Printing system 20 includes print unit or module 22, dryer unit or module 24, input 26 and controller 28. Print module 22 selectively deposits printing material upon web 30 to form an image, pattern, layout or arrangement of printing material upon web 30. In one embodiment, web 30 may comprise a web of printing material such as by cellulose-based media. In another embodiment, web 30 may comprise a web of polymeric material. In yet another embodiment, web 30 may comprise one or more other materials. In one embodiment, the printing material comprises a fluid such as one or more inks. In yet other embodiments, the printing material may comprise other types of fluid.

Print module 22 includes a printer 34, actuator 35, web flow path 36 and web drive 38. Printer 34 comprises a device or mechanism configured to selectively deposit printing material. Printer 34 includes support 42 and one or more pens or cartridges 44. Support 42 comprises a structure configured to support cartridges 44 opposite to web 30. In the particular example illustrate account support 42 is configured to support cartridges 44 along an arc opposite to web 30. In one embodiment, support 42 is movable towards and away from web 30. In yet another embodiment, support 42 is stationary opposite to web 30.

Cartridges 44 comprise mechanisms configured to eject fluid onto web 30. In the particular example illustrated, cartridges 44 each include one or more print heads 46 (schematically shown on one of cartridges 44). In one embodiment, print heads 46 each comprise thermal resistive drop-on-demand inkjet print heads. In yet other embodiments, print heads 46 may comprise piezo resistive inkjet print heads. In still other embodiments, print heads 46 may comprise other mechanisms configured to eject fluid in a controlled manner.

According to one embodiment, cartridges 44 each include a self-contained reservoir of fluid which is applied to the associated print heads 46. In yet another embodiment, cartridges 44 each include a reservoir which is further supplied with fluid or ink via an offer-axis ink supply system using one or more pumps or other mechanisms to supply a fluid to each of cartridges 44. In one embodiment, cartridges 44 of printer 34 are configured to apply multiple colors of ink. In the embodiment illustrated, cartridges 44 configured to deposit black (K), cyan (C), magenta (M) and yellow (Y) colored inks. In the example illustrated, printer 34 is additionally configured to apply a fixer (F) to web 30 prior to application of the colored inks. In other embodiments, printer 34 may include a fewer or greater number of such cartridges configured to apply a fewer or greater number of such different types of fluid.

Actuator 35 comprise a mechanism configured to selectively raise and lower support 42 to raise and lower cartridges 44 relative to web flow path 36 and web 30. As a result, support 42 may be moved to facilitate enhanced access to cartridges 44 for inspection, repair or replacement. In some embodiment, movement of support 42 and cartridges 44 may further facilitate servicing of print heads 46.

In one embodiment, actuator 35 comprises one or more hydraulic or pneumatic cylinder assemblies. In another embodiment, actuator 35 comprises one or more electric solenoids. In yet another embodiment, actuator 35 may comprise one or more cams driven by one or more motors. In such an embodiment, support 42 may be guided by one or more guide rods, tracks or other guide structures. In still other embodiments, actuator 35 may be omitted.

Web flow path 36 comprises a path formed by one or more stationary or movable structures along which web 30 is guided and moved. In the particular example illustrated, web flow path 36 is formed by overhead rollers 50, 52, 54, 56, arcuately arranged rollers 60, and control roller 62, 64. Rollers 50, 52, 54 and 56 guide and direct web 30 along path 36 over, around and about print support 42 and cartridges 44. Although path 36 is illustrated as utilizing rollers 50, 52, 54 and 56 for directing web 30 over and around support 42, in other embodiments, path 36 may include a greater or fewer of such rollers for directing web 30 around support 42. In still other embodiments, other structures may be used to guide web 30 over and around support 42. For example, stationary structures such as arcuate panels or plates, or pairs of opposing nip rollers may be used to guide or direct web 30 around support 42.

Arcuately arranged rollers 60 comprise a series of cylinders or rollers supported in an arc by a support 66 opposite to support 42 and cartridges 44. In one embodiment, support 66 supports rollers 60 which rotate about their individual axes. Rollers 60 facilitate relatively smooth movement of web 30 with minimal friction upon web 30. In other embodiments, rollers 60 may include a greater or fewer of such rollers or may include other structures configured to support web 30 in an arc opposite to support 42. For example, in another embodiment, rollers 60 may be replaced with a drum or one or more arcuate platens or plates. In some embodiments, support 66 may be vertically movable towards and away from cartridges 44 either manually or using one or more actuators similar to actuator 35.

Control rollers 62, 64 comprise independently rotationally driven rollers which define or form web flow path 36 and which move web 30 along web flow path 36. Roller 62 is located immediately upstream of cartridges 44 and their associated print heads 46. Roller 64 is located immediately downstream of cartridges 44 and their associated print heads 46 along web flow path 36. Rollers 62 and 64 form or define a printing zone across support 66 and rollers 60. Rollers 62 and 64 are configured to be driven at different speeds, facilitating adjustment of the tension of web 30 across an opposite to cartridges 44 during printing upon web 30. Alternatively, rollers 62 and 64 may be driven at substantially the same speed, facilitating precise velocity control of web 30 across the printing zone formed by rollers 62, 64 and rollers 60.

As further shown by FIG. 1, web flow path 36 is inverted multiple times. In particular, when entering print model 22, web flow path 36 is flowing in a first direction as indicated by arrow 70. At roller 56, the direction in which web flow path 36 is moving is inverted such that web 30 is redirected and moves in a second opposite direction as indicated by Arrow 72. Web flow path 36 continues in an arc over rollers 60 opposite to cartridges 44 until it is once again inverted at roller 64 to once again flow in the direction indicated by arrow 70. Web flow path 36 continues to flow "downstream" in the direction indicated by arrow 70 until leaving print module 22.

The repeated inversion of web flow path 36 and web 30 facilitates a reduction in occupied floor space of system 20 and enhances print quality. In particular, the inversion of web flow path 36 facilitates a 3 degree to 5 degree wrap around each roller 60 such that rollers 62 and 64 provide a satisfactory downward force holding web 30 against rollers 60 for reliable and precise clearance and controlled feeding of web 30 relative to print heads 46. As a result, print quality may be enhanced. At the same time, the repeated inversion of web flow path 36 and web 30 facilitates discharging a web 30 in generally the same direction as which web 30 enters print module 22, reducing occupied floor space and simplifying the layout of system 20.

Web drive 38 comprises one or more maxims configured to rotationally drive roller 62 and 64. In the example illustrated, web drive 38 includes motors 72 and 74. Motor 72 is operably coupled to roller 62 while motor 74 is operably coupled to rollers 64. In one embodiment, roller 72 and 74 comprise servo motors with associated encoders. In another embodiment, motors 72, 74 may comprise other controllable sources of torque. In still other embodiment, web drive 38 may comprise a single motor configured to selectively supply distinct levels of torque or velocity to rollers 62 and 64 using one or more transmissions and clutch mechanisms.

Dryer module 24 comprises an arrangement of components configured to dry printing material that is deposited upon web 30 by printer 34 of printer module 22. Dryer module 24 includes dryer 76, web flow path 78 and web drive 80. Dryer 76 comprises a device configured to dry printing material upon web 30. In one embodiment, dryer 76 comprises a device configured to blow heated hot dry high volume forced air (convection) onto one or more faces of web 30. In another embodiment, heater 76 may additionally or alternatively apply infrared heat, ultraviolet heat or other forms of the heat or energy, such as microwaves, to dry the printing material upon web 30. In the particular example illustrated, dryer 76 emits heat in the direction as indicated by arrows 82 to dry face 84 of web 30. As shown by FIG. 1, dryer 76 is oriented in a general vertical direction, having a major dimension extending upward. As a result, system 20 is more compact and occupies less floor space.

Web flow path 78 comprises an arrangement of one or more structures configured to guide and direct movement of web 30 through dryer module 24 and relative to dryer 76. Web flow path 78 includes guide rollers 86, 88, and 90, and control roller 92. Rollers 86, 88 and 90 direct web 30 in a substantially vertical direction, as indicated by arrow 94 across dryer 76. At the same time, rollers 86, 88 and 90 direct web 30 upward, over and downward across dryer 36 such that face 84 wraps around three sides of dryer 36 before being turned and discharged by roller 92. Roller 86 contacts a backside of web 30, opposite to face 84. As a result, the printing material upon face 84 is dried before being contacted and is less likely to be smeared. In addition, web 30 is directed between dryer 76 and print module 22, reducing transfer or direction of heat towards printer 34. In other embodiments, one or more of rollers 86, 88 and 90 may alternatively be replaced with one or more arcuate or curved plates, structures or the like which otherwise direct web 30.

Control roller 92 comprises an independently rotationally driven roller in contact with web 30 which defines or forms web flow path 78 and which moves web 30 along web flow path 78. Roller 92 is located immediately downstream of dryer 76 after roller 90. Roller 92 cooperates with rollers 64 of the print module 22 to form a drying zone which extends across dryer 76. Control roller 92 is configured to be rotationally driven at a distinct torque or distinct velocity with respect to the torque or velocity of rollers 64, facilitating control over the tension of web 30 across dryer 76. Alternatively, rollers 92 and 64 may be rotationally driven at substantially the same velocity to precisely control the velocity of web 30 across dryer 76.

In the particular example illustrated, rollers 62, 64 and 92 drive web 30 as a result of web 30 partially wrapping about such rollers. With roller 64, this results in the potentially wet printed upon side or face of web 30 not contacting a roller. In other embodiments, one or more or rollers 62,64 and 92 may alternatively utilize an opposing nip roller to drive web 30.

Web drive 80 is similar to web drives 72 and 74. Web drive 80 comprises one or more mechanisms configured to rotationally drive roller 92. In the example illustrated, web drive 80 comprises a servo motor (with associated encoder). In other embodiments, web drive 80 may comprise other controllable sources of torque. In still other embodiment, web drive 80 may be provided as part of web drive 38, wherein web drive 38 comprises a single motor configured to selectively supply distinct levels of torque or velocity to rollers 62, 64 and 92 using one or more transmissions and clutch mechanisms. In the example illustrated, drives 72 and 74 are directly coupled to the shafts of the rollers to ensure accurate position reading with the encoders and reduce or eliminate gear backlash.

Input 26 comprises one or more mechanism by which instructions are commands may be provided to controller 28. Example of input 26, include, but are not limited to, a keyboard, a keypad, a touchpad, a touchscreen, a microphone with speech recognition software, one or more buttons, switches and the like. Although input 26 is illustrated as being associated with print model 22, input 26 may alternatively be associated with dryer module 24 or may be an external source of commands which transmits control signals via the internet, a network or other wired or wireless communication medium.

Controller 28 comprises one or more processing units and associated memories configured to generate control signals directing the operation of print module 22 and dryer module 24. In particular, controller 28 generates control signals directing operation of actuator 35 to selectively raise and lower support 42 and cartridges 44, control signals directing the application or deposition of printing material by cartridges 44 and printed to 46, control signals directing the velocity or torque provided by motor 72, 74 to control the velocity or tension of web 30 across printer 34, control signals directing a rate which heat or energy is provided by dryer 76 and control signals directing the torque or velocity of web drive 80 to control the velocity or tension of web 30 across dryer 76.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor to any particular source for the instructions executed by the processing unit.

According to one embodiment, system 20 may be actuated to distinct modes of operation. For example, in one of mode of operation pursuant to commands received via input 26, controller 28 may generate control signal such that motor 72 and 74 drive rollers 62 and 64 at different speeds to control the tension of the web 30 across cartridges 44 during start up. As a result, web 30 may be set at a desired tension prior to printing.

During printing, controller 28 may generate control signal such that motors 72 and 74 drive rollers 62 and 64 at substantially the same controlled speed to control the velocity of the web across cartridges 44 during printing. Controller 28 may generate control signals directing the motor of web drive 80 to drive roller 92 at a distinct speed or velocity as compared to roller 64 to control the tension of web 30 across dryer 76. Because the tension of web 30 may be set to different levels across printer 34 as compared to across dryer 76, enhanced printing and drying results may be achieved.

Overall, system 20 provides several benefits. For example, web flow path 36 minimizes damage to printed images by reducing contact of the print upon material and the surfaces of rollers 64 and 78 prior to drying. Web flow path 36 facilitates use of a curved path for more accurate print head to media spacing control. Because web flow path 36 inverts, media is more reliably held against roller 64 to further enhance control over such spacing. In addition, overall machine size and floor space is reduced by the vertical nature of path 36. Web flow path 36 and the provision of control rollers 62, 64 and 92 provide precise control over the tension and/or velocity of the movement of web 30 across printer 34 and across dryer 76. For example, tension may be controlled so as to allow for media expansion (higher tension) in the print zone (region between rollers 62 and 64) and media contraction (lower tension) in the drying zone (region between rollers 64 and 92). As a result, the likelihood of contact between the web 30 and the printheads 46 and wrinkling of the media are reduced.

Figure 2:
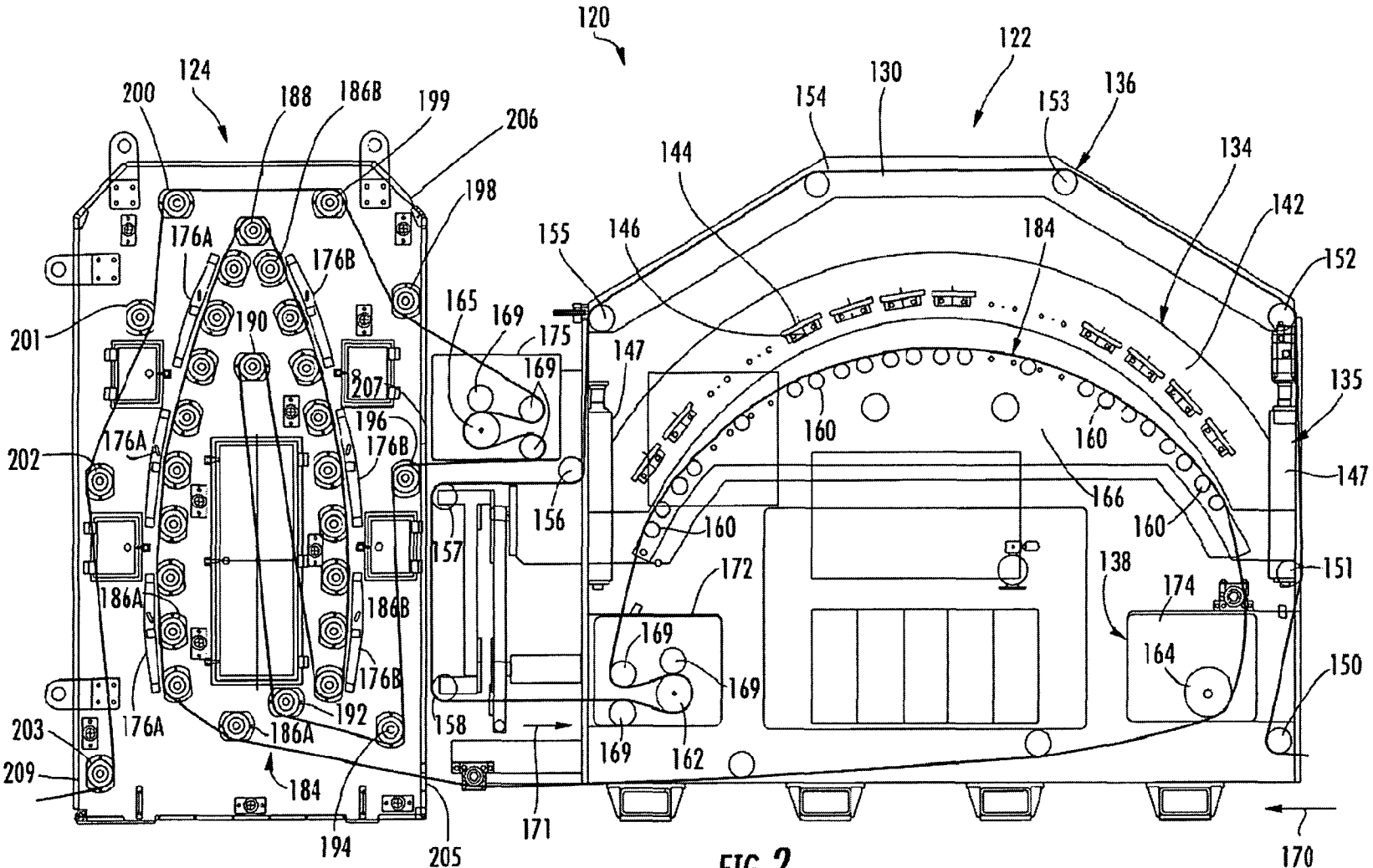
FIG. 2 is a side elevation of you illustrating another embodiment of the printing system of FIG. 1 according to an example embodiment.
Figure 3:
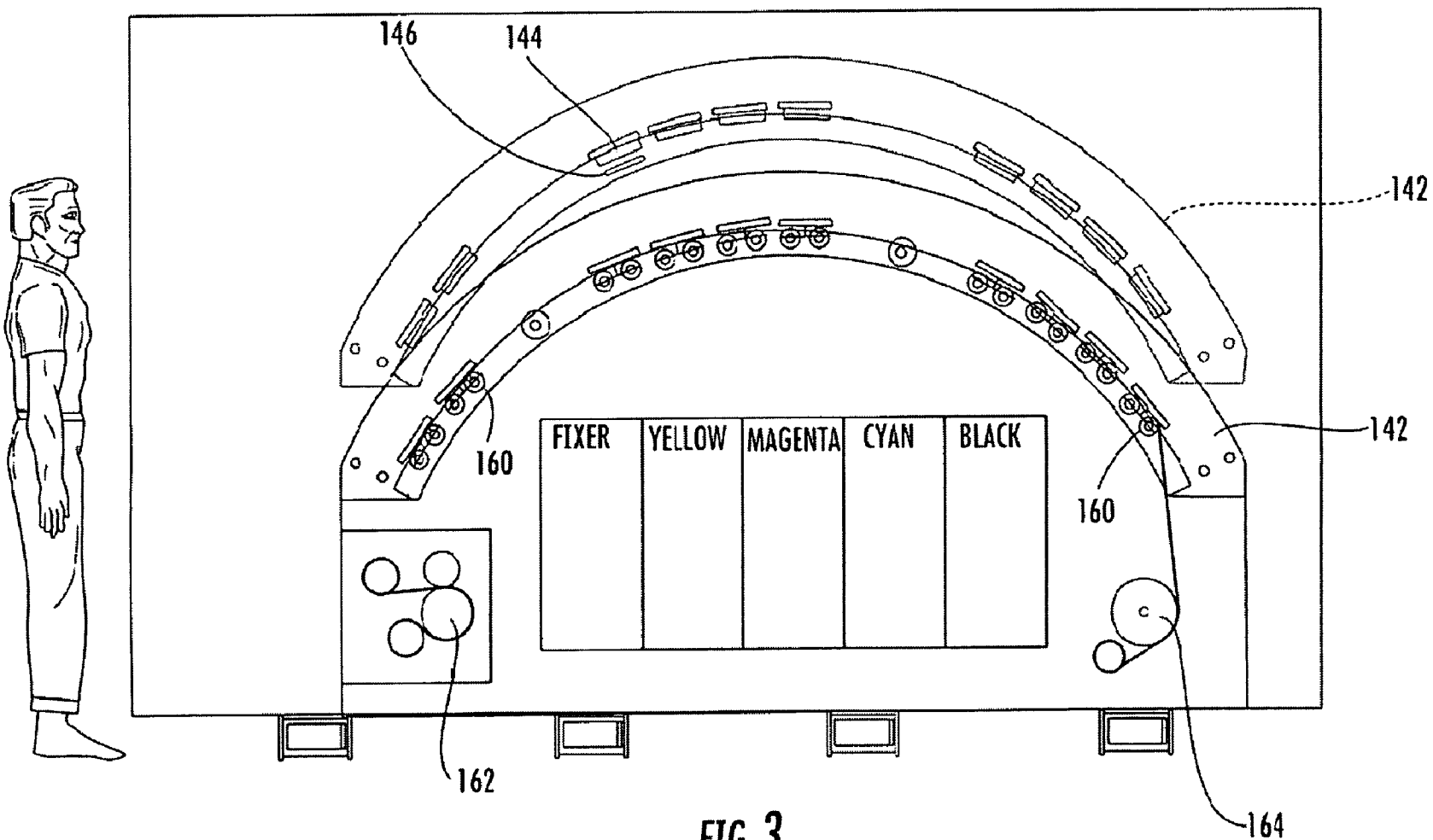
FIG. 3 is a side elevation of view of a print module of the printing system of FIG. 2 illustrating print heads in raised and lowered positions according to an example embodiment.

FIGS. 2 and 3 illustrate printing system 120, another embodiment of printing system 20. Like printing system 20, printing system 120 is configured to print upon a web of print media. Printing system 120 is further configured to dry the printed image on the web of media while having a layout and a web flow path that facilitate enhanced print quality and occupies less floor space.

As shown by FIG. 2, system 120 includes print module 122 and dryer module 124, input 26 (shown in FIG. 1) and controller 28 (shown in FIG. 1). Print module 22 selectively deposits printing material upon web 130 to form an image, pattern, layout or arrangement of printing material upon web 130. In one embodiment, web 130 may comprise a web of printing material such as by cellulose-based media. In another embodiment, web 130 may comprise a web of polymeric material. In yet another embodiment, web 130 may comprise one or more other materials. In one embodiment, the printing material comprises a fluid such as one or more inks. In yet other embodiments, the printing material may comprise other types of fluid.

Print module 122 includes a printer 134, actuator 135, web flow path 136 and web drive 138. Printer 134 comprises a device or mechanism configured to selectively deposit printing material. Printer 134 includes support 142 and one or more pens or cartridges 144. Support 142 comprises a structure configured to support cartridges 144 opposite to web 130. In the particular example illustrated, support 142 is configured to support cartridges 144 along an arc opposite to web 130. In the embodiment illustrated, support 142 is movable towards and away from web 130. In yet another embodiment, support 142 is stationary opposite to web 30.

Cartridges 144 comprise mechanisms configured to eject fluid onto web 130. In the particular example illustrated, cartridges 144 each include one or more print heads 146 (schematically shown on one of cartridges 144). In one embodiment, print heads 146 each comprise thermal resistive drop-on-demand inkjet print heads. In yet other embodiments, print heads 146 may comprise piezo resistive inkjet print heads. In still other embodiments, print heads 146 may comprise other mechanisms configured to eject fluid in a controlled manner.

According to one embodiment, cartridges 144 each include a self-contained reservoir of fluid which is applied to the associated print heads 146. In yet another embodiment, cartridges 144 each include a reservoir which is further supplied with fluid or ink via an off-axis ink supply system using one or more pumps or other mechanisms to supply a fluid to each of cartridges 144. In one embodiment, cartridges 144 of printer 134 are configured to apply multiple colors of ink. In the embodiment illustrated, cartridges 44 configured to deposit black (K), cyan (C), magenta (M) and yellow (Y) colored inks. In the example illustrated, printer 34 is additionally configured to apply a fixer (F) to web 130 prior to application of the colored inks. In other embodiments, printer 134 may include a fewer or greater number of such cartridges configured to apply a fewer or greater number of such different types of fluid.

Actuator 135 comprise a mechanism configured to selectively raise and lower support 142 to raise and lower cartridges 144 relative to web flow path 136 and web 130. As a result, support 142 may be moved to facilitate enhanced access to cartridges 44 for inspection, repair or replacement. In some embodiments, movement of support 142 and cartridges 144 may further facilitate servicing of print heads 146.

In the embodiment illustrated, actuator 135 comprises one or more hydraulic or pneumatic cylinder assemblies 147. In another embodiment, actuator 135 comprises one or more electric solenoids. In the yet another embodiment, actuator 135 may comprise one or more cams driven by one or more motors. In such an embodiment, support 142 may be guided by one or more guide rods or other guide structures. In still other embodiments, actuator 135 may be omitted.

Web flow path 136 comprises a path formed by one or more stationary or movable structures along which web 130 is guided and moved. In the particular example illustrated, web flow path 136 is formed by overhead rollers 150, 151, 152, 153, 154, 155, 156, 157 and 158, arcuately arranged rollers 160 and control rollers 162, 164, 166. Rollers 150-158 guide and direct web 130 along path 36 over, around and about print support 42 and cartridges 44 generally to control roller 162. Although path 136 is illustrated as utilizing rollers 150-158 for directing web 130 over and around support 142, in other embodiment, path 136 may include a greater or fewer of such rollers for directing web 130 around support 142. In still other embodiments, other structures may be used to guide web 130 over and around support 142. For example, stationary structures such as arcuate panels or plates may be used to guide or direct web 130 around support 142.

Arcuately arranged rollers 160 comprise a series of rotationally supported cylinders or rollers supported in an arc by a support 166 opposite to support 42 and cartridges 144. In one embodiment, support 166 supports rollers 160 which rotate about their individual axes. Rollers 160 facilitate relatively smooth movement of web 130 with minimal friction upon web 130. In other embodiment, rollers 160 may include a greater or fewer of such rollers or may include other structures configured to support web 130 in an arc opposite to support 142. For example, in another embodiment, rollers 160 may be replaced with one or more arcuate platens or plates.

Control rollers 162, 164 comprise independently rotationally driven rollers which define or form web flow path 136 and which move web 130 along web flow path 136. Roller 162 is located immediately upstream of cartridges 144 and their associated print heads 146. Roller 164 is located immediately downstream of cartridges 144 and their associated print heads 146 along web flow path 136. Rollers 162 and 164 form or define a printing zone across support 166 and rollers 160. Rollers 162 and 164 are configured to be driven at different speeds, facilitating adjustment of the tension of web 130 across an opposite to cartridges 144 during printing upon web 30. At the same time, rollers 162 and 164 may be driven at substantially the same speed, facilitating precise velocity control of web 130 across the printing zone formed by rollers 162, 164 and rollers 160.

Control roller 165 comprises an independently rotationally driven roller which further partially defines web flow path 136. Control roller 165 engages or contacts web 130 after web 130 has left printer module 122 and has passed through dryer module 124. In operation, control roller 165 pulls web 130 partially through dryer module 124 despite being physically associated with printer model 122. Because printer module 122 includes control roller 165, the cost and complexity of dryer model 124 is reduced. Likewise, control of the velocity of control roller 165 may be more easily facilitated using controller 28 (shown and described with respect to FIG. 1) which is also physically associated with print module 122. In other embodiments, control roller 165 may alternatively be provided as part of dryer module 124.

As further shown by FIG. 2, each of control rollers 162 and 166 is preceded and succeeded by additional guide rollers 169. Guide rollers 169 facilitate wrap of web 130 about control rollers 162 and 165. In other embodiment, such additional guide rollers 169 may be omitted.

As further shown by FIG. 2, web flow path 136 is inverted multiple times. In particular, when entering print model 122, web flow path 136 is flowing in a first direction as indicated by arrow 170. At roller 158, the direction in which web 130 is moving is inverted such that web 130 is redirected and moves in a second opposite direction as indicated by arrow 171. Web flow path 136 continues in an arc over rollers 160 opposite to cartridges 144 until it is once again inverted at roller 164 to once again flow in the direction indicated by arrow 170. Web flow path 136 continues to flow "downstream" in the direction indicated by arrow 170 until leaving print module 122 for a first time prior to reentering print module 122 at control roller 165.

Web drive 138 comprises one or more mechanisms configured to rotationally drive rollers 162, 164 and 165. In the example illustrated, web drive 138 comprises servo motors 172, 174 and 175 (with associated encoders). In other embodiments, web drive 138 may comprise other controllable sources of torque. In still other embodiments, web drive 138 may comprise a single motor configured to selectively supply distinct levels of torque or velocity to rollers 162, 164 and 165 using one or more transmissions and clutch mechanisms.

Dryer module 124 comprises an arrangement of components configured to dry printing material that is deposited upon web 130 by printer 134 of printer module 122. Dryer module 124 includes dryers 176A, 176B (collectively referred to as dryers 176) and web flow path 178. Dryers 176 comprise devices configured to dry printing material upon web 130. In one embodiment, dryers 176 comprise devices configured to blow heated air onto one or more faces of web 130. In another embodiment, heaters 176 may additionally or alternatively apply infrared heat or other forms of the heat or energy, such as microwaves, to dry the printing material upon web 130.

In the particular example illustrated, dryers 176 includes one or more dryers 176 substantially facing in direction 170 and one or more dryer 176 substantially facing in direction 171, wherein web flow path 178 guides web 130 between such opposite dryers 176 with the printed upon face of web 130 facing outwardly towards each of the opposed sets of one or more dryers 176. In addition, as with dryer 76, dryers 176 are substantially vertical. Thus, dryer module 124 and system 120 are more compact and occupy less floor space.

Web flow path 178 comprises an arrangement of one or more structures configured to guide and direct movement of web 130 through dryer module 124 and relative to dryers 176. Web flow path 178 includes guide rollers 186A, 186B (collectively referred to as guide rollers 186), inverter roller 188, return roller 190, exit rollers 192, 194 and 196, and reentry in discharge rollers 198, 199, 200, 201, 202 and 203. Guide rollers 186A direct Web 130 from dryer module input opening 205, in the outer enclosure or housing 206, across and opposite to dryers 176A with the printed upon face 184 of web 130 facing dryers 176A. Likewise, guide rollers 176B guide and direct movement of web 130 opposite to dryers 176B with face 184 facing dryers 176B. Inverter roller 188 is located between rollers 186A and 186B. Web 130 wraps approximately 180 degrees about roller 188 as it changes direction from an upward direction when moving across dryer 176A to a substantially downward direction when moving across dryer 176B. Because web 130 directed in this up-and-down vertical path, dryer module 124 more effectively dries web 130 with dryer module 124 occupying less floor space.

Return roller 190 comprises a rotationally supported roller between rollers 186A and 186B. As shown by FIG. 2, web 130 wraps about the last of rollers 186B and once again extends upwardly until wrapping about roller 190. After wrapping about roller 190, web 130 directed vertically downward across roller 192, around roller 194 and outward after being guided by roller 196. Return roller 190 enables web 130 to once again pass between opposed heaters 176A and 176B for further heating and further drying. Thereafter, rollers 192-196 direct web 130 out discharge opening 207 formed in the outer enclosure or housing 206 of dryer module 124.

As shown by FIG. 2, web 130 is then directed from roller 196 about control roller 165 associated with printer module 122. After being driven by control roller 165, web 130 reenters web flow path 178 of dryer module 124. Rollers 198-203 guide and direct web 130 over and around dryers 176 down to a second discharge opening 209 in housing 206. Web 130 is discharged from dryer module 124 in substantially the same direction arrow 170 at which web 130 entered print module 122 of system 120. Consequent, web flow paths 136 and 178 enable system 122 print and dry web 130 in an effective manner while occupying less floor space. Consequent, web flow paths 136 and 178 and able system 122 print and dry web 130 in an effective manner while occupying less floor space.

Although dryer module 124 is illustrated as utilizing the illustrated serpentine web flow path 178 using the noted rollers, in another embodiment, dryer module 124 may utilize other serpentine web flow paths. In another embodiment, dryer module 124 may include other arrangements of rollers. In other embodiments, dryer module 124 may include other types of guides for guiding web 130 and directing movement of web 130 through dryer module 124. In some embodiments, dryer module 124 may include other types of dryers or dryers differently arranged within dryer module 124.

In operation, controller 28 (shown in FIG. 1) generates control signals directing motors 172, 174 and 175 to rotationally drive control rollers 162, 164 and 165, respectively, so as to control the tension and velocity of web 130. In particular, controller 28 generates control signals controlling the application of torque provided by rollers 162 and 164 to control the velocity and positioning of web 130 across rollers 160 opposite to print heads 146 of cartridges 144. At the same time, controller 28 generates control signals directing actuator 135 to position cartridges 144 into close proximity to face 184 of web 130. Controller 128 generates control signals directing fluid or printing material, such as ink, to be ejected onto face 184 by print heads 146.

Controller 20 also generates control signals controlling the amount of heat provided by dryers 176. At the same time, controller 28 generates control signals directing motor 175 to rotationally drive control roller 165 to control the tension and velocity of web 130 through dryer module 124. In one embodiment, controller 28 may be configured to operate in different modes at different times based upon command received via input 26 (shown in FIG. 1) or based upon instructions contained in an associated computer readable medium or memory. For example, in one embodiment, controller 28 may initially adjust the tensioning of web 130 by causing rollers 162, 164 to be driven a different velocities. Once an appropriate tension has been set, controller 28 may generate control signals causing rollers 162, 164 to be driven at substantially the same velocity contribute control positioning of web 130 during printing. As web 130 is being moved through system 120, controller 28 may also generate control signals causing rollers 165 to be driven at a speed or velocity distinct from rollers 162 164. As a result, controller 28 may control the tension of the web 130 as it is being dried. This tension may be different from the tension of the web 130 across rollers 160 and opposite to cartridges 144.

At certain points in time, cartridges 144 or their print heads 146 may be repaired, replaced or serviced. At such times, controller 28 may generate control signals causing actuators 135 to raise or lift support 142 and cartridges 144 away from rollers 160 and that portion of web flow path 136 between rollers 160 and cartridges 144. FIG. 3 illustrates support 142 in a raised, servicing position as compared to the lowered, deployed and printing position. Consequently, system 120 enables access to print heads 146 from both above and below for replacement and servicing.

As shown in FIG. 2, printer module 122 and dryer module 124 comprise separate and distinct modules contained in separate and distinct enclosures or housings, wherein such modular positioned in close proximity or adjacent to one another to facilitate transfer of web 130 therebetween. Because system 120 includes distinct modules 122, 124, printer module 122 may be used independently of dryer module 124 either by itself or with other dryer modules. Likewise, dryer module 124 may be used independently of printer module 122. In other embodiments, the components of print modules 122 and dryer module 124 may alternatively be house are contained within a single enclosure or housing.

Figure 4:
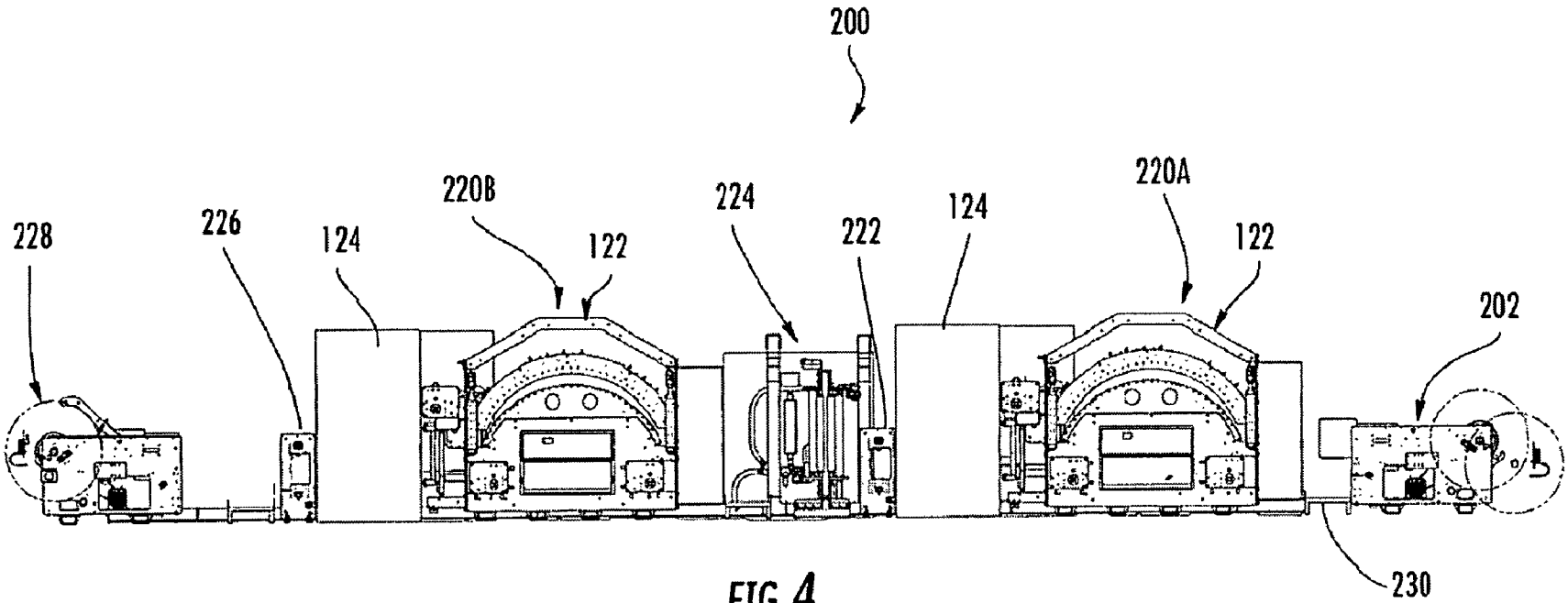
FIG. 4 is a side elevation of view of a duplexer system according to an example embodiment.

FIG. 4 schematically illustrates the duplexing system 200. Duplexing system 200 is configured to print upon opposite sides of a web of media. Duplexing system 200 includes web supply 202, printing systems 220A, 220B (collectively referred to as printing systems 220), sensors 222, web inverter 224, sensors 226 and web collection 228. Web supply 200 comprises a supply of web 230 which is unwound and delivered to printing system 220A across a walkway or intermediate platform 230.

Printing systems 220 are each identical to printing system 120 (shown and described with respect to FIGS. 2 and 3). In particular, each printing system 220 includes a print module 122 and a dryer module 124. Printing system 220A receives a web of media and prints upon a first face of the web in print module 122. The first face of the web is dried in dryer module 124 of system 220A.

Sensor 222 comprises one or more sensors configured to detect quality and accuracy of the image printed upon the first face of the web. In one embodiment, sensor 222 comprises a vision system, such as a video or camera system, configured to sense or detect quality and accuracy of the image printed upon the web. Sensor 222 is located between dryer module 124 of system 220A and web inverter 224. Sensor 222 the first face of the web as it passes between system 220A and inverter 224. Sensor 222 transmits signals communicating the sensed results to controller 28 (shown in FIG. 1) which adjusts the operation of the various components of duplexing system 220 based upon such results.

Web inverter 224 comprise a mechanism configured to invert, flip or turn over the web of printing material such that system 220B prints upon a second opposite face of the same web. In the example embodiment illustrated, inverter 224 comprises an air driven turn bar or turn unit commercially available from EMT International located in Green Bay, Wisconsin or Hunkeler AG. In other embodiments, web inverter 124 may comprise other mechanisms or devices between systems 220A and 220B that configured to flip or overturn a web of media.

Printing system 220B receives the overturn web and prints upon the second opposite side of the web using print module 122. Dryer module 124 dry the second opposite side after his ages printed upon. Thereafter, the web, having been printed on both sides, is discharged and rewound by web collector 228.

In the example illustrated, duplexing system 200 includes sensor 226 between printing system 220B and web collector 228. As with sensor 222, sensor 226 senses, detects or verifies the quality or accuracy of the printed image upon the second side of the web. Sensor 226 transmits are communicates signals communicating the results to controller 28 (shown in FIG. 1) which adjusts operating parameters based upon the sense results. For example, in response to signals from center to 22, controller 28 may adjust the velocity of the web, the tension of the web, the spacing or positioning of support 142 and cartridges 144 relative to the web or printing parameters of print heads 146, or the output of dryers 176 of print system 220A. Likewise, in response to signals from sensor 226, controller 28 may adjust the velocity of the web, the tension of the web, the spacing or positioning of support 142 and cartridges 144 relative to the web, the printing parameters of print heads 146, or the output of dryers 176 of print system 220B. In other embodiments, one or both of sensors 222, 226 may be omitted.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:
one or more print heads;
a dryer;
a web flow path extending in a first direction opposite the one or more print heads and in a second opposite direction from the one or more print heads to the dryer;
a first driven roller preceding the one or more print heads;
a second driven roller succeeding the one or more print heads;
one or more motors coupled to the first driven roller and the second driven roller; and
a controller configured to operate in a tension control mode directing the one or more motors to drive the first roller and the second roller at different speeds and a velocity control mode driving the first roller and the second roller at substantially the same speed for velocity control, wherein the controller is configured to operate in a tension control mode during start up and a velocity control mode during printing with the one or more print heads.

2. The apparatus of claim 1, wherein the web flow path opposite to the one or more print heads is arcuate.

3. The apparatus of claim 1, wherein the flow path extends on opposite sides of the one or more print heads.

4. The apparatus of claim 1, wherein the web flow path is located between the one or more print heads and the dryer upstream of the one or more print heads and is located between the one or more print heads and the dryer downstream of the one or more print heads.

5. The apparatus of claim 1, wherein the web flow path is configured such that a face of a web moving along the web flow path is not contacted after being printed upon by the one or more print heads prior to being dried by the dryer.

6. The apparatus of claim 1, wherein the dryer comprises a module separated from the one or more print heads.

7. The apparatus of claim 1, wherein the first driven roller immediately precedes the one or more print heads and wherein the second driven roller immediately succeeds the one or more print heads.

8. The apparatus of claim 7 further comprising a third driven roller succeeding the dryer.

9. The apparatus of claim 8 comprising:
a dryer module enclosing the dryer; and
a printer module including the print heads and the third driven roller.

10. The apparatus of claim 9, wherein the web flow path consecutively exits the printer module, enters the dryer module, enters the printer module, enters the dryer module and exits the dryer module.

11. The apparatus of claim 1 further comprising a print head support supporting the one or more print heads in an arc.

12. The apparatus of claim 11 further comprising an actuator configured to raise and lower the print head support and the one or more print heads relative to be web flow path.

13. The apparatus of claim 11, wherein the media support comprises a plurality of arcuately arranged rollers.

14. The apparatus of claim 1, wherein the web flow path extends vertically across the dryer.

15. The apparatus of claim 1, wherein the web flow path extends in the second direction upstream of the one or more print heads.

16. A method comprising:
moving a web of media in a first direction across one or more print heads; and
moving the web of media in a second opposite direction from the one or more print heads to a dryer;
moving the web in the second direction over the print heads rip or to moving the web of media in the first direction across the one or more print heads;
inverting the web upstream of the one or more print heads prior to moving the web of media in the first direction across the one or more print heads;
inverting the web downstream of the one or more print heads beneath the one or more printheads and about a roller such that a first face of the web printed upon by the one or more printheads faces away from the roller;
moving the web in a first vertical direction between the one or more print heads and the dryer; and
moving the web in a second vertical direction between the one or more print heads and the dryer.

17. The method of claim 16, wherein the moving of the web of media in the first direction across the one or more print heads comprises moving the web of media in an arc.

18. The method of claim 16 further comprising guiding the web downstream of the one or more print heads from the roller to the dryer with a second roller that contacts a second face of the web opposite to the first face of the web.

19. A method comprising:
moving a web of media in a first direction across one or more print heads;
moving the web of media in a second opposite direction from the one or more print heads to a dryer;
moving the web in a first vertical direction between the one or more print heads and the dryer; and
moving the web in a second vertical direction between the one or more print heads and the dryer.

* * * * *

UNITED STATES PATENT AND TRADEMARK OFFICE

CERTIFICATE OF CORRECTION

PATENT NO. : 8,220,889 B2
APPLICATION NO. : 12/251968
DATED : July 17, 2012
INVENTOR(S) : Paul C. Ray et al.

It is certified that error appears in the above-identified patent and that said Letters Patent is hereby corrected as shown below:

In column 1, line 6, delete "The" and insert -- This application claims the benefit of US provisional patent application Ser. No. 60/987,026, filed on Nov. 9, 2007, entitled "WEB FLOW PATH". The --, therefor.

In column 12, line 35, in Claim 16, delete "rip or" and insert -- prior --, therefor.

Signed and Sealed this
First Day of January, 2013

David J. Kappos

David J. Kappos
*Director of the United States Patent and Trademark Office*